US005507593A

United States Patent [19]

Hollon et al.

[11] Patent Number: 5,507,593

[45] Date of Patent: Apr. 16, 1996

[54] UNIFORM COMPACTION OF ASPHALT CONCRETE

[76] Inventors: Edmund D. Hollon, 130 Frontier Dr.; Blake D. Hollon, 1941 Park Dr., both of Douglas, Wyo. 82633

[21] Appl. No.: 239,310

[22] Filed: May 6, 1994

Related U.S. Application Data

[63] Continuation-in-part of Ser. No. 60,331, May 10, 1993, Pat. No. 5,336,019.

[51] Int. Cl.[6] ..... E01C 19/26

[52] U.S. Cl. ..... 404/122; 404/125; 404/127

[58] Field of Search ..... 404/103, 112, 404/114, 126, 127, 122, 125, 132, 117

[56] References Cited

U.S. PATENT DOCUMENTS

| | | | |
|---|---|---|---|
| 1,847,043 | 2/1932 | Ball | 405/30 |
| 2,876,628 | 3/1959 | Dixon | 405/20 |
| 3,072,025 | 1/1963 | Cronin | 404/127 |
| 3,146,686 | 9/1964 | Grace et al. | 404/127 |
| 4,683,156 | 7/1987 | Waters | 405/20 X |
| 5,114,269 | 5/1992 | Shepherd | 404/122 |
| 5,304,013 | 4/1994 | Parsons | 404/127 |

FOREIGN PATENT DOCUMENTS

| | | | |
|---|---|---|---|
| 1534363 | 8/1969 | Germany | 404/127 |
| 1906288 | 9/1970 | Germany | 404/127 |
| 2254733 | 5/1974 | Germany | 404/127 |

*Primary Examiner*—Ramon S. Britts
*Assistant Examiner*—James A. Lisehora
*Attorney, Agent, or Firm*—Dean P. Edmundson

[57] ABSTRACT

Apparatus is described for obtaining uniform compaction of asphalt concrete to reduce or prevent cracking of the asphalt concrete surface. A mobile confinement edge force is maintained in contact with the edge surface of an asphalt concrete mat while the mat is being compacted. This is performed in a manner such that the density of the mat across the full width of the mat becomes uniform. By obtaining uniform density of each lane of the mat as it is laid significantly reduces the incidence of joint cracking and deterioration of the asphalt concrete, in the longitudinal joint area, over time.

14 Claims, 14 Drawing Sheets

UNIFORM COMPACTION OF ASPHALT CONCRETE

CROSS-REFERENCE TO RELATED APPLICATION

This application is a continuation-in-part of our earlier application Ser. No. 08/060,331, filed May 10, 1993, now U.S. Pat. No. 5,336,019.

FIELD OF THE INVENTION

This invention relates to compaction of asphalt concrete. More particularly, this invention relates to means for obtaining uniform compaction of asphalt concrete to reduce or prevent cracking of the asphalt concrete surface. In another aspect, this invention provides apparatus for use in obtaining uniform compaction of asphalt concrete.

BACKGROUND OF THE INVENTION

Cracking in asphalt concrete surfaces is very common and has been a problem ever since the use of asphalt concrete began. With the advent of the asphalt laydown machine, to lay the hot mix asphalt concrete, came the longitudinal joint cracking. For surfaces which are not laid between curbs or forms, longitudinal joint cracking occurs. This problem has become accepted as an inevitable built-in flaw.

Of course, as soon as cracking develops, water can enter the cracks. When the water freezes it expands and causes further cracking and break-up of the asphalt concrete. Patching of the cracks is always necessary to prevent deterioration of the asphalt concrete surface. In warm climates, such as the Los Angeles Basin, which never experiences freeze-thaw there is a somewhat different but as bad a longitudinal cracking problem along these joints. The area next to the joint, not being properly compacted, has an excessively high volume of air voids. This causes the joint to break up much wider than just a simple crack. This type of cracking is much more difficult to repair than just a simple open crack. Eventually the asphalt concrete will usually be overlaid with new surfacing. This new overlay does not solve the problem for more than just a short time because the new overlay will crack above the old crack. This is a severe problem known as reflection cracking. Filling the cracks will only prolong the time of reflection cracking a short time. Reflection cracks are caused by vertical or horizontal movement in the pavements beneath the overlay. Filling the crack does not reinforce the crack but it can be reinforced with geotextile fabric. This fabric is usually not applied except when there is extensive cracking such as alligator and/or shrinkage cracking. In other words, the common practice is to just bury the longitudinal crack and then live with a new longitudinal crack. Cracking is discussed by Paul Schmidt in "Better Crack Repair", Pavement Maintenance, pp. 253–257 (September, 1991).

The weakest point of any asphalt pavement is generally along a construction joint, particularly the longitudinal paver joint. The density of the asphalt concrete is typically 2 to 5% lower at the longitudinal joint than in the remainder of the asphalt concrete.

There are many factors which can affect the quality and longevity of these joints. Cracks along joints occur primarily because of bond failure between adjacent asphalt concrete lanes. Many weak points are developed during construction through improper luting techniques, improper compaction, or improper paver overlap. Other weak areas are caused by the presence of dirt and debris or by the cold and possibly poor condition of the existing edge to be matched.

Any object expands in hot weather and contracts in cold weather. Consequently, conventional Portland cement concrete (PCC) parking lots and highways include expansion joints (usually with felt or other such material placed in the joints). When the (PCC) concrete expands, it compresses the material in the joints, thus relieving the tremendous internal stresses. Without such stress-relieving mechanisms, (PCC) concrete highways and parking lots can experience severe buckling and breaking.

On the other hand, asphalt concrete pavements are not built with expansion joints. They are flexible (non-rigid) pavements with an internal system of stress-relieving air voids. For most parking lots, compacted asphalt concrete includes air voids which constitute about 5 to 8% of the volume.

For airport projects, the Federal Aviation Administration now considers compacted pavement air voids so important that it will penalize contractors for too many voids (under-compaction) or too few voids (over-compaction).

Tennis courts and play areas often have wide thermal cracks that develop within 3 to 10 years. Contractors and producers generally prefer a very fine velvet-like surface for these applications. They therefore increase the dust and asphalt binder content on these projects, which in turn reduces the compacted pavement air voids.

In the long term this good intention can result in the formation of wide thermal cracks which are so common. The pavement's air voids are filled with dust and asphalt cement, thereby plugging the internal stress-relief mechanism. As a result, the pavement must form its own stress-relief system, namely a wide expansion joint or crack. The width of these cracks increases in cold weather and decreases in hot weather. Freezing, of course, causes the pavement to expand or heave.

Asphalt concrete is typically laid down by a paving machine which receives a bulk amount of heated asphalt concrete mixture (commonly known as hot mix asphalt) and then meters the mixture into an eight to twelve feet wide (or wider) onto the road base as the machine moves forwardly. For paving narrower lanes, a portion of an eight foot paver can be blocked off. There are also narrower walkway paving machines. This lane is also often referred to as a pass. Multiple lanes are laid side by side until the asphalt concrete mat has covered the entire width of the roadway or other surface to be covered.

Each lane is compacted by a very heavy roller machine which includes a large cylindrical drum or a plurality of closely spaced pneumatic tires, or a combination of both. The compacting machine is driven repeatedly over each lane of the asphalt concrete after it is laid to compact or consolidate the material. For the purpose of the present invention, the terms "compacting" and "consolidating" are used interchangeably to refer to the act of packing or compressing the asphalt concrete to a desired density. After one lane has been laid and then compacted, another lane is laid down adjacent to the longitudinal edge of the first lane, after which it is also compacted.

The main problem with conventional compacting techniques, in our opinion, is that there is nothing to hold the hot asphalt concrete mix material along the edge of the mat when it is being compacted or consolidated by the roller machine. As a result, the edge of the mat has a lower density (e.g., 2 to 5% lower). It is this reduced density along the longitudinal joint of adjoining lanes which ultimately leads to cracking between the lanes of the asphalt concrete mat over time which is longitudinal joint cracking.

To our knowledge, the only asphalt concrete roller which has included anything to compact the edge surface of an asphalt concrete mat is a machine sold by Bomag which included a small tapered wheel supported along one side of the large cylindrical packing drum. Apparently this wheel was provided primarily for making a more cosmetically acceptable edge surface to the mat. Because the wheel was mounted to the large roller with a solid mounting, no means were provided for applying a predetermined pressure to the edge of the mat. Consequently, when the large roller moved laterally with respect to the mat, the small wheel either applied no pressure to the edge or it applied a very large amount of pressure which can vary constantly between these two extremes.

Recently Bomag has shown in a publication an attachment to large vibratory tandems which is identified as an edge roller/cutter to hold the outer edge of an asphalt lift to reduce lateral expansion and increase compaction. The roller can be detached from the apparatus and replaced with a cutter wheel having a sharpened edge. The roller has a working surface which is disposed at an angle of 30° off horizontal. The roller does not appear to be able to provide controlled uniform density of an asphalt lift.

Another manufacturer (Hamm) provides a side roller having a working surface which is angled at 45° from horizontal. The roller includes a sharpened outer edge which can cut asphalt concrete. The lower edge of the roller is only two inches below the cylindrical packing drum.

The foregoing edge rollers do not include any means permitting lateral adjustment thereof. Further, the foregoing apparatus does not include means for adjusting the pressure exerted on the edge of an asphalt lift by the roller.

The other longitudinal cracking, edge cracking, can occur on the edge of any mat, be it a narrow walkway or a hundred foot wide highway. If the edge of the mat is not properly compacted to obtain uniform density, those outside few inches do not have the cohesive strength of the balance of the mat.

Although it is common practice to roll the edge surface of the roadway to round the edge, this is for cosmetic reasons and does not result in uniform compaction of the asphalt concrete edge.

There has not heretofore been provided an effective technique or apparatus for reducing or eliminating the formation of cracks in asphalt concrete surfaces.

SUMMARY OF THE PRESENT INVENTION

In accordance with the present invention there is provided a method and apparatus for obtaining uniform compaction of asphalt concrete when it is laid so as to reduce or minimize the incidence of cracking of the asphalt concrete over time. Uniform compaction is obtained by providing a longitudinally mobile and adjustable confinement edge force which is in contact with the edge surface of the asphalt concrete mat. Then when the asphalt concrete mat is compacted, the edge surface of the mat is confined by the edge force in a manner such that the density of the mat across its full width becomes uniform. When each asphalt concrete lane or pass is compacted in this manner, the entire finished surface (either a roadway, parking lot, or other asphalt concrete paved area) is of uniform density. This greatly reduces or eliminates the weak spots in the finished surface and accordingly reduces cracking of the surface.

The compacting apparatus of this invention could be an attachment for any common asphalt concrete compactor or it may comprise a self-contained compacting machine.

Other advantages of the method and apparatus of this invention will be apparent from the following detailed description and the accompanying drawings.

BRIEF DESCRIPTION OF THE DRAWINGS

The invention is described in more detail herein after with reference to the accompanying drawings, wherein like reference characters refer to the same parts throughout the several views and in which.

DETAILED DESCRIPTION OF THE INVENTION

Figure 1:
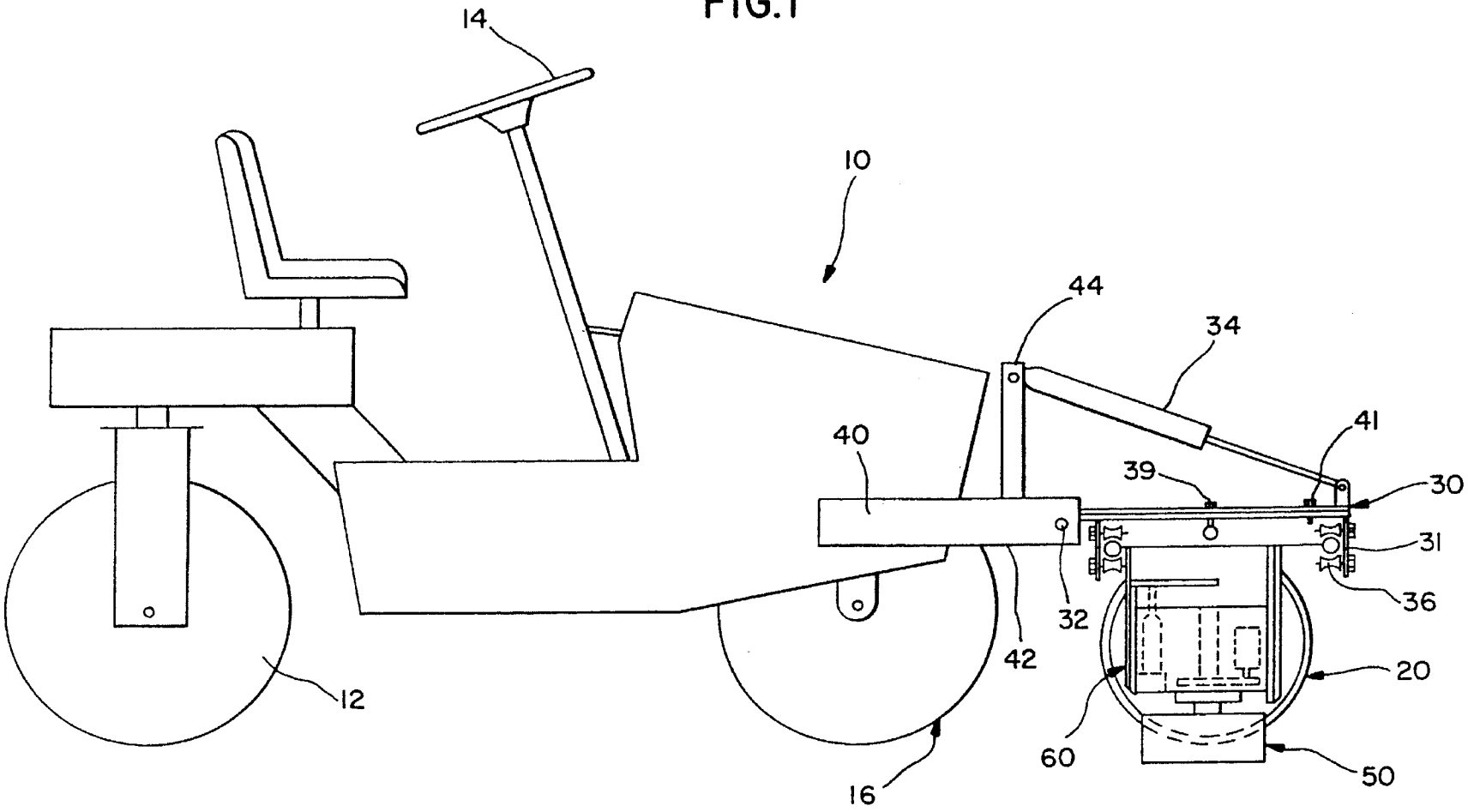
FIG. 1 is a side elevational view of one embodiment of apparatus which is useful in this invention.

The present invention provides method and apparatus for obtaining uniform density across the full width of an asphalt concrete mat. The method involves first laying down a hot mix of asphalt concrete mat on a prepared base, in accordance with conventional techniques. Each asphalt concrete lane includes an outer edge surface.

The width of such an asphalt concrete lane is typically about 8 to 12 feet, and the depth of the lane may vary from about 1 to 4 inches or more per course or lift. The lane is normally compacted by means of a powered vehicle which includes a large cylindrical drum or a plurality of closely spaced pneumatic tires. As the vehicle is driven back and forth several times over the lane, the asphalt concrete becomes compacted (i.e., consolidated) to the desired degree. Normally the asphalt concrete is compacted until it reaches a density of 90 to 95% of maximum theoretical density. After one asphalt concrete lane has been laid down and then compacted, another asphalt concrete lane is conventionally laid down adjacent to, and in contact with, the first lane. Then the second lane is compacted in a manner similar to the first lane. Successive lanes may be laid down in similar fashion, depending upon the desired width for the roadway, parking lot, etc. being surfaced.

Conventionally, the edge surface of an asphalt concrete lane is not confined during the compacting process. As a result, the edge of the lane typically has a density less than that of the remainder of the lane. This can lead to cracking in the surface along the joint between adjacent lanes.

In the present invention a longitudinally mobile and adjustable confinement edge force is provided in contact with the edge surface of the asphalt concrete lane during the compacting of the lanes in a manner such that the density of the mat across its full width becomes uniform. The mobile edge force is provided against the vertical edge of the asphalt concrete lane so as to confine the edge surface of the lane in a controlled manner during compacting.

In one embodiment, the mobile edge force is provided by means of a vertical roller adjacent to one end of a cylindrical drum. Alternatively, the mobile edge force may be provided by means of a shoe member (either fixed or vibrating), or it may be provided by means of an endless belt supported by spaced-apart rollers or a belt backer plate. Other equivalent means may also be used.

The longitudinally mobile confinement edge force is maintained in contact with the edge surface of the lane during the compaction of the lane by a cylindrical drum or vibrating plate. The amount of force exerted against the edge surface of the lane is adjustable so that any desired degree of density in the asphalt concrete lane may be obtained. Once a predetermined edge force has been selected, the vertical roller (or shoe, etc.) which provides the edge force is adapted to maintain this predetermined force value as the compacting vehicle moves over the top of the lane. The amount of vertical force applied to the top of the lane is also adjustable so that the desired density of the asphalt concrete across the full width of the mat is obtained.

The apparatus for obtaining uniform density across the full width of an asphalt concrete lane in accordance with this invention comprises a powered vehicle having steering means. The vehicle may include a large cylindrical drum rotating about a horizontal axis, and apparatus may be attached to the forward end of the vehicle for applying uniform compacting force to the asphalt concrete. Alternatively, the apparatus for applying uniform compacting force may be attached to the forward end of conventional compacting apparatus.

Preferred apparatus for use in this invention is illustrated in the drawings. In the embodiment shown, a compacting vehicle 10 comprises a vehicle having an engine or other suitable power source, steerable rear roller wheels 12, steering wheel 14, and a large cylindrical compacting drum 16. Attached to the forward end of the vehicle is a cylindrical drum 20 carried by a base frame 30 which is hingedly attached to mounting bracket 40. The drum 20 is adapted to rotate about a horizontal axis. Preferably drum 20 is rotatably driven, although it may be freely rotatable, if desired. The bracket 40 includes forwardly projecting arm 42 and upstanding arm 44. The rearward end of frame 30 is attached to bracket 40 by means of a continuous hinge 32. Connected between the upstanding arm 44 and the forward end of frame 30 is a hydraulic cylinder 34. By applying hydraulic fluid pressure to this cylinder 34, the forward end of frame 30 is urged downwardly, thereby causing drum 20 to apply more downward force to an asphalt concrete lane being consolidated by the vehicle. As more or less hydraulic fluid pressure is applied to the hydraulic cylinder 34, more or less downward force is applied to the lane by drum 20. The hydraulic fluid pressure applied to cylinder 34 can be adjusted in many known ways. For example, an adjustable pressure regulator valve may be used in conjunction with the cylinder control valve. Thus, an adjustable regulator valve can be adjusted in a manner such that a predetermined or fixed pressure is maintained in the cylinder 34. In this manner, the downward force exerted by drum 20 on the asphalt concrete surface remains constant at the desired force. Hydraulic cylinder 34 also is used to raise the drum 20 upwardly out of the way when it is not in use.

As the vehicle 10 is propelled, both of the rotating cylindrical drums 16 and 20 apply downward force to the asphalt concrete lane. The force applied by drum 20, however, is adjustable, as explained above.

A longitudinally mobile and adjustable confinement edge force may be applied to the edge surface of the lane by means of vertical roller 50 which is adjacent one end of drum 20 and which extends below the bottom surface of the drum 20. The roller 50 is preferably mounted in framework 60 which is attached to and carried by framework 33. The ends of the axle 22 on which drum 20 rotates are also supported by framework 33.

The vehicle on which the apparatus is mounted maintains contact with the top surface of the asphalt concrete at all times and applies significant downward force to compact the asphalt concrete. The vehicle is of sufficient size and weight to counteract the horizontal thrust created by the roller force on the asphalt concrete outer edge. This vehicle could be of many different configurations with any imaginable means of locomotion, most preferably an asphalt concrete compactor of rotating drums or pneumatic tires or a combination of both drums and tires. This subject device could be an attachment for any common asphalt concrete compactor or it may comprise a self-contained compacting machine.

The forward portion of the apparatus shown in FIG. 1 is responsible for assuring that the asphalt concrete is compacted to a uniform density. This portion of the apparatus comprises (a) a cylindrical drum 20 which rotates about an axle 22 in a horizontal plane; (b) a roller 50 which rotates about a vertical axis on shaft 51; (c) hinged frame 30 attached to the forward end of the compacting apparatus; and (d) side shift framework 33.

The cylindrical drum 20 is carried on axle 22 which rotates in a horizontal plane. The axle is supported in framework 33. Arm 33A supports one end of the axle and plate 33B supports the other end of the axle. The axle is driven by means of gear 26 (which is coupled to gear 25 by drive chain 27). Gear 26 is driven by hydraulic motor 26A.

The width of drum 20 may vary. It does not have to be as wide as main packing drum 16. It is driven at the same rim speed, and in the same direction, as packing drum 16.

The diameter of drum 20 may also vary. It is important, however, for the "footprint" of drum 20 to be smaller than the "footprint" of the main drum 16 in the apparatus shown. Thus, either the diameter or the length, or both, of drum 20 is smaller than that of drum 16 so that drum 16 does not move laterally with respect to the asphalt mat when edge force is applied to the mat by the apparatus described herein. Preferably the vertical compacting force supplied by drum 20 is substantially the same (in terms of p.s.i.) as that supplied by drum 16.

Framework 33 includes spaced-apart parallel tubular rails 35 connected by a horizontal plate. The rails 35 are each supported between upper and lower rollers 36 which are rotatably carried by frame 31.

One end 47A of hydraulic cylinder 47 is supported by frame 31 and is attached at its opposite end to framework 33 in a manner such that extending the rod portion of this cylinder causes the framework 33 to shift laterally to the left relative to the main drum 16. Conversely, retracting the rod portion of the cylinder causes the framework 33 to shift laterally to the right of drum 16.

Vertical roller 50 is attached to the lower end of vertical shaft 51 which is carried by housing 52. The shaft 51 is preferably rotatably driven by means of hydraulic motor 54 coupled to a gear on shaft 51 by chain 57. It is not necessary, however, for roller 50 to be rotatably driven. Instead, it may be freely rotatable.

Figure 2:
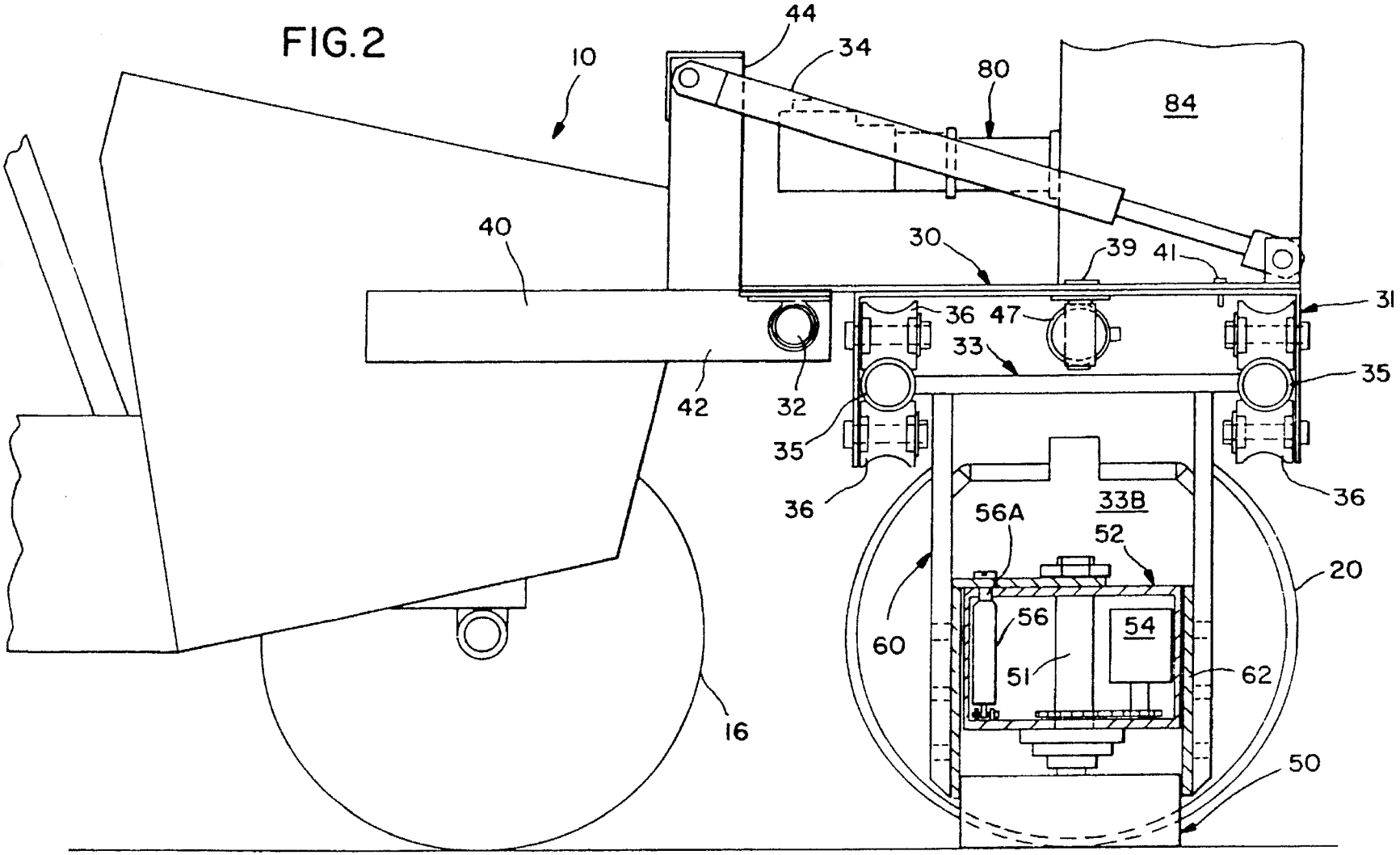
FIG. 2 is a side elevational view of the forward or front portion of the apparatus of FIG. 1.
Figure 3:
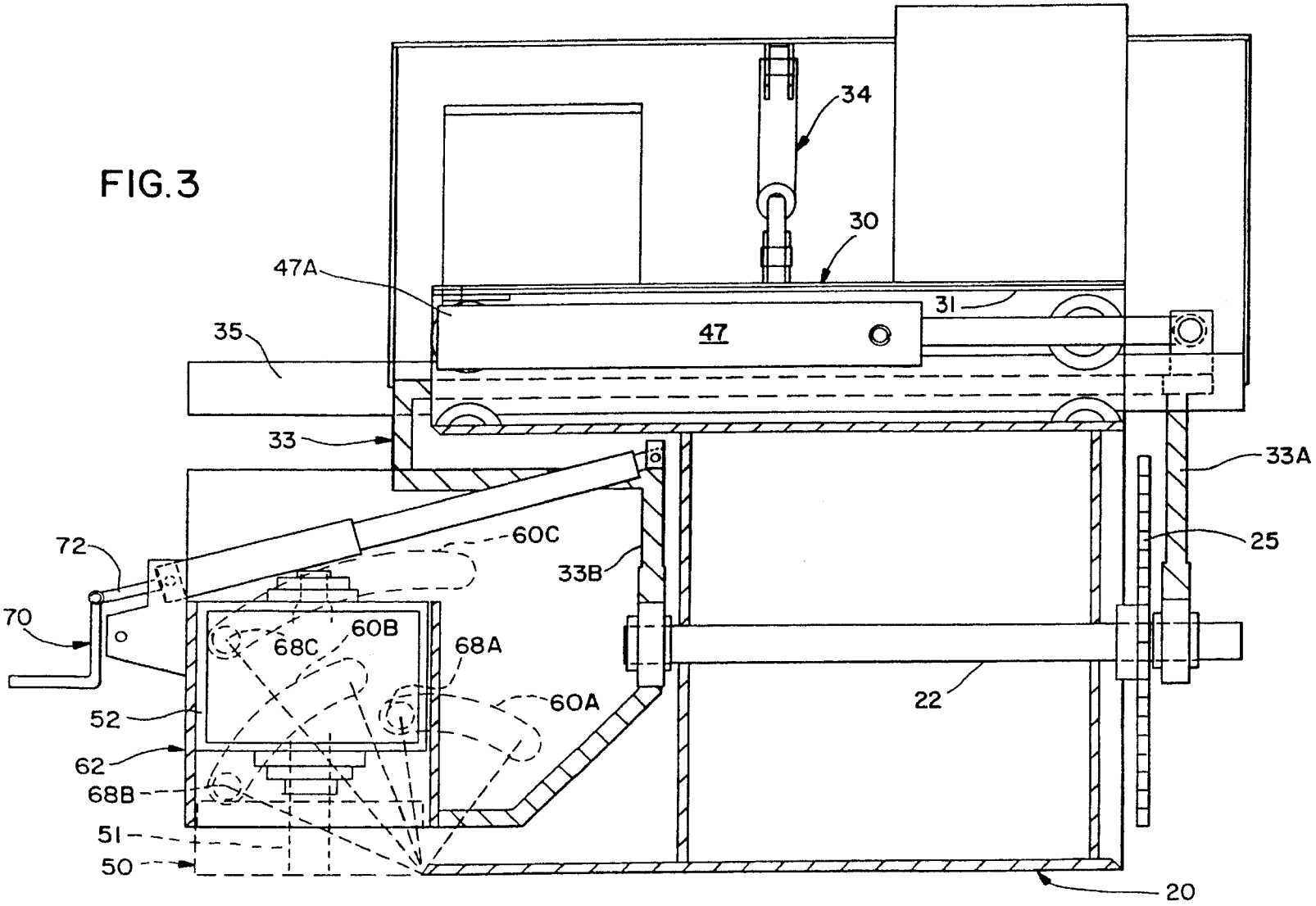
FIG. 3 is a cut-away view of the forward end of the apparatus shown in FIG. 1.
Figure 4:
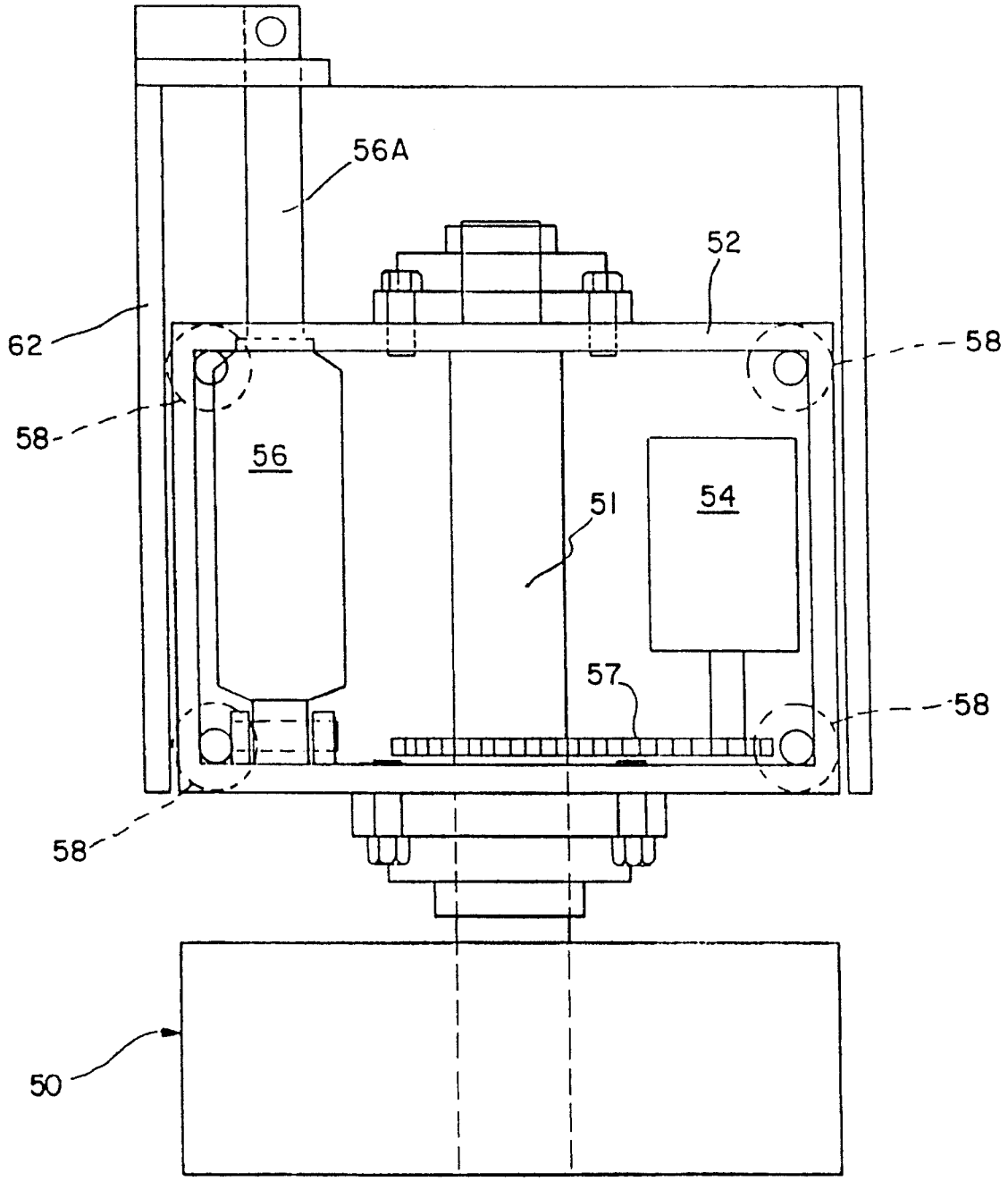
FIG. 4 is a side elevational cut-away view of the vertical roller assembly used in the apparatus of the invention.
Figure 5:
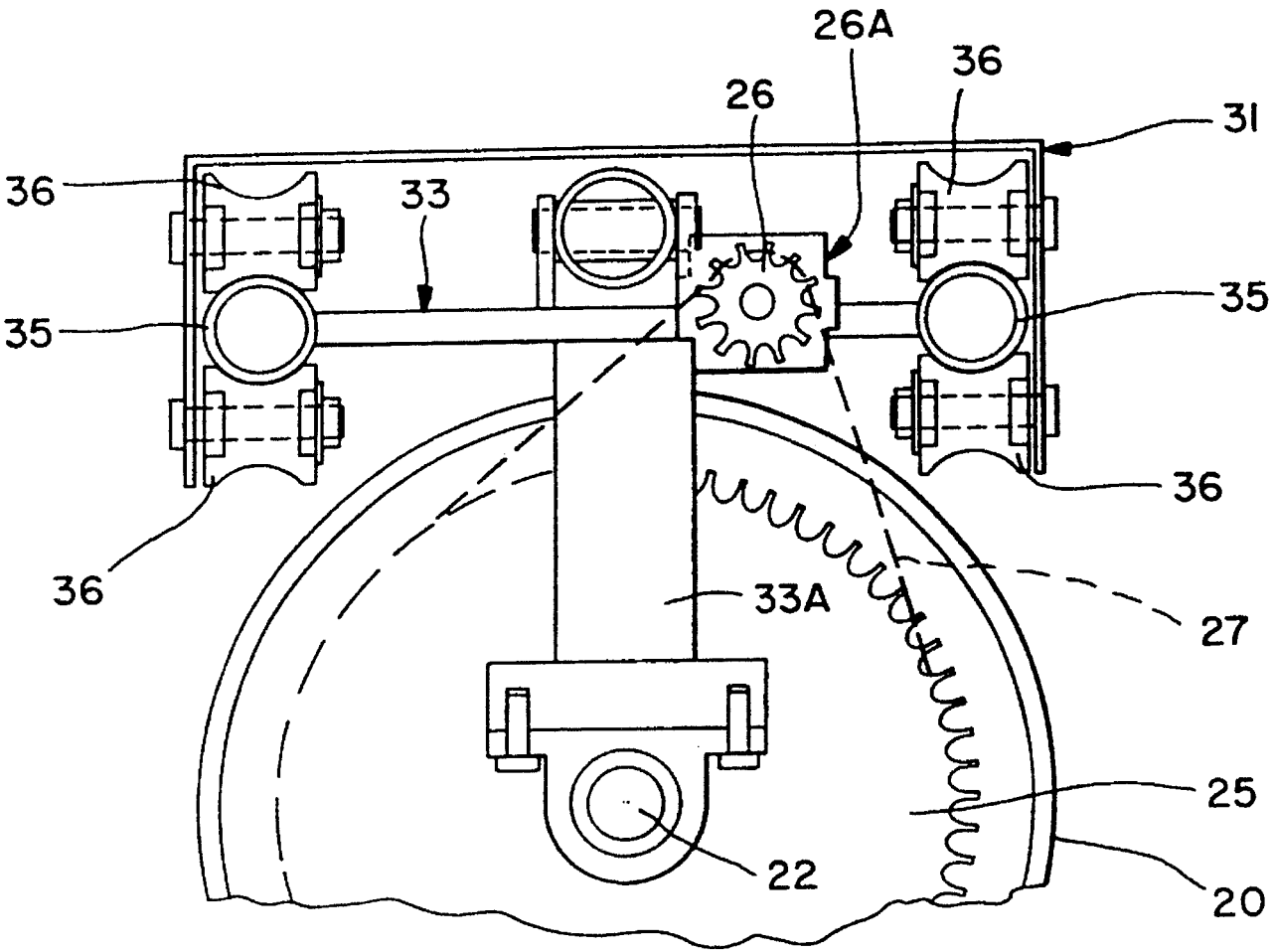
FIG. 5 is a side elevational view of the opposite side of the forward portion of the apparatus shown in FIG. 2.

Housing 52 (and thus roller 50) can be selectively raised or lowered by operation of hydraulic cylinder 56 which is secured in housing 52. The rod portion 56A of the cylinder is attached to a mounting bracket or arm secured to enclosure 62. Rollers 58 are mounted on the corners of housing 52 and engage the interior side surfaces of enclosure 62 to reduce friction between housing 52 and enclosure 62. In FIGS. 2 and 3 the vertical roller 50 is shown in its raised position. In FIG. 4 the roller 50 is shown in its lowered position.

Vertical plates 60, which support enclosure 62, include slotted apertures 60A, 60B and 60C and define pathways or guides for rollers 68A, 68B, and 68C which are rotatably carried by the front and rear walls of enclosure 62. This arrangement enables enclosure 62 to pivot or tilt laterally. By doing so, housing 52 and vertical roller 50 also are tilted laterally. Crank 70 at the outer end of threaded rod 72 can be used to rotate rod 72 to cause enclosure 62 to tilt in the desired direction. Such adjustability enables the edge surface of an asphalt lane to be sloped at any desired angle from vertical to 45° to accommodate contractor preference.

By means of hydraulic cylinder 47, the drum 20 and vertical roller 50 can be caused to move laterally to the left or to the right. In this manner, the amount of pressure or force applied to the vertical edge surface of an asphalt concrete lane can be adjusted to a desired amount. It is preferred to control the operation of hydraulic cylinder 47 by means of a regulator valve which maintains a constant hydraulic pressure in the cylinder 47. This results in a constant predetermined force to be applied by the vertical roller against the edge surface of the asphalt concrete lane regardless of uneven asphalt concrete edge variations or driver lateral wandering. Consequently, a desired uniform compaction of the asphalt concrete is obtained. This lateral movement ability of roller 50 eliminates the virtually impossible task of the compactor operator being required to keep a compacting vehicle aligned with the edge of the mat being compacted.

Another feature of the apparatus shown in the drawings is that the frame 31 is pivotably mounted beneath frame 30 by means of king pin 39. A bolt or pin 41 extending through registering openings in frames 30 and 31 normally secures frame 31 in the position shown in FIG. 2. After removing bolt or pin 41, frame 31 can be rotated 180° relative to frame 30. This is desirable because it enables the vertical roller 50 to be used on either the left side or the right side of the apparatus for compacting the edge of an asphalt lane.

Figure 6:
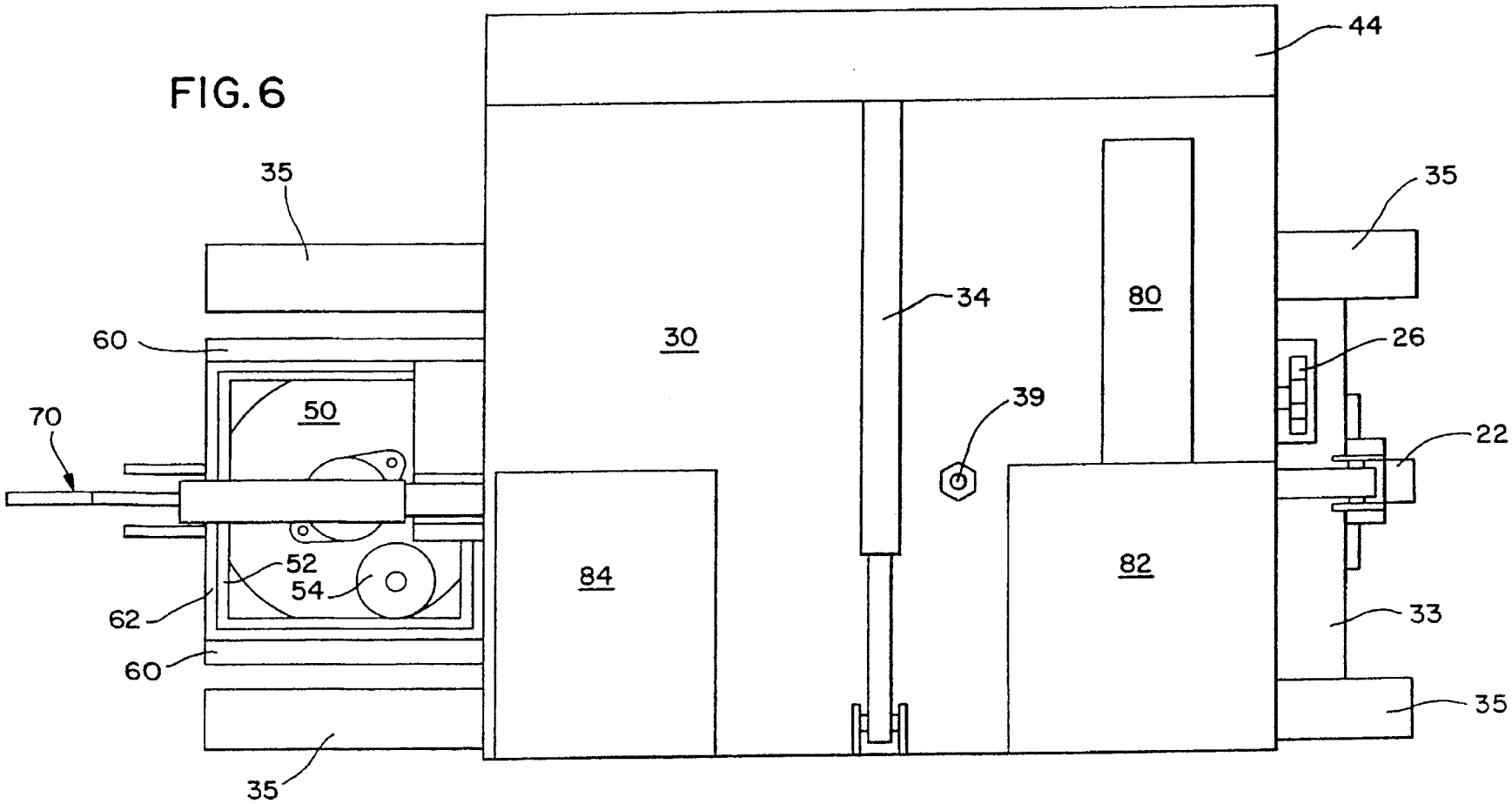
FIG. 6 is a top view of the forward end of the apparatus of FIG. 1.
Figure 7:
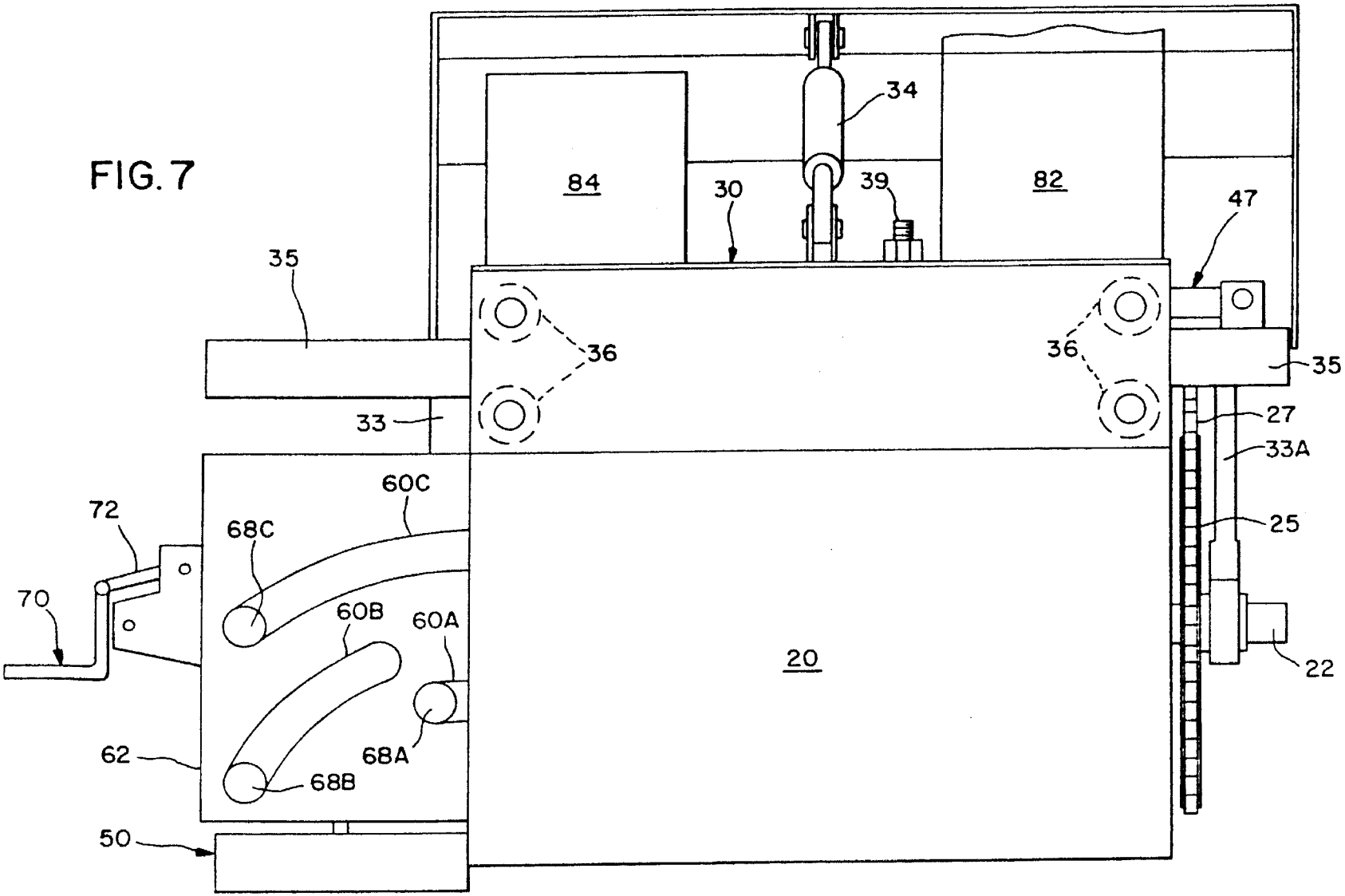
FIG. 7 is a front elevational view of the apparatus of FIG. 1.

In FIG. 6 (top view of apparatus) there is shown a hydraulic pump 80 which is powered by an engine 82. A hydraulic oil supply tank 84 is also shown. These components are supported on base frame 30. The hydraulic pump is operably connected to cylinders 34 and 47 and the other hydraulically-operated components at the forward end of the apparatus.

Figure 8:
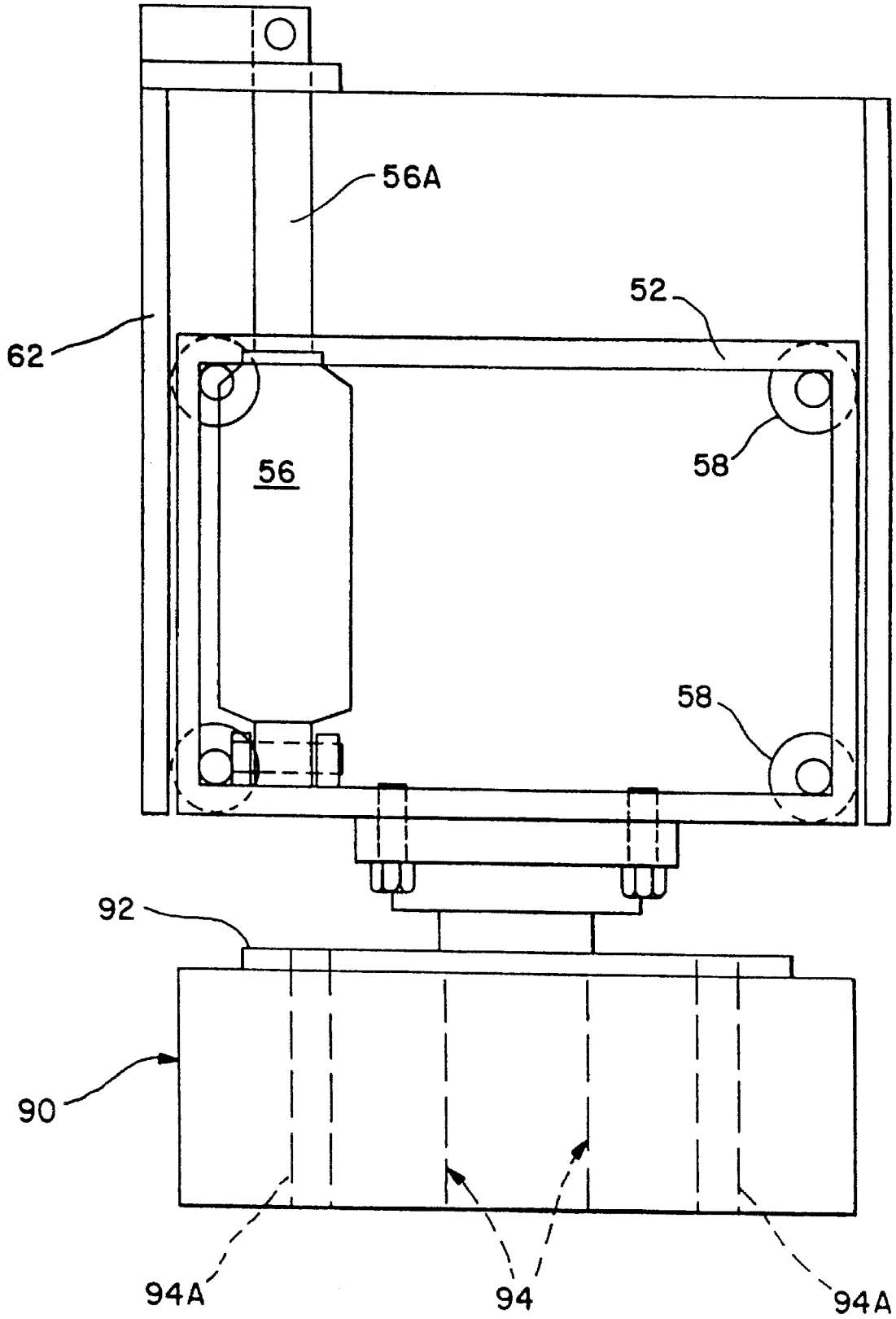
FIG. 8 is a side elevational view of another embodiment of edge compacting apparatus of the invention.

FIG. 8 is a side elevational view illustrating another embodiment of apparatus for applying the longitudinally mobile confinement edge force to the side edge of an asphalt lane being compacted by cylindrical drum 20. The apparatus shown in FIG. 8 utilizes an endless belt 90 in place of the vertical roller 50 shown in the previous drawings. The belt 90 extends around two rotatable rollers 94 which are spaced apart and are able to rotate around vertical axles 94A carried by plate or bracket 92. The bracket 92 is attached to the lower end of housing 52 which can be raised or lowered, as desired, by means of hydraulic cylinder 56. The belt 90 presents a vertical confinement edge force against the edge of the asphalt concrete being compacted by the apparatus described herein. Although it is not necessary to apply power to axles 94A for rotating rollers 94 and belt 90, this may be done if desired.

The belt 90 is flexible and may be composed of any suitable material such as metal (e.g., stainless steel). The length and height of the belt may vary, as desired. It is also possible to include a backing plate between the two rollers 94 and adjacent the belt for the purpose of preventing the belt from deflecting away from the edge of the asphalt lane during compacting. It is also possible to connect vibrating apparatus to the belt support bracket, if desired.

Figure 9:
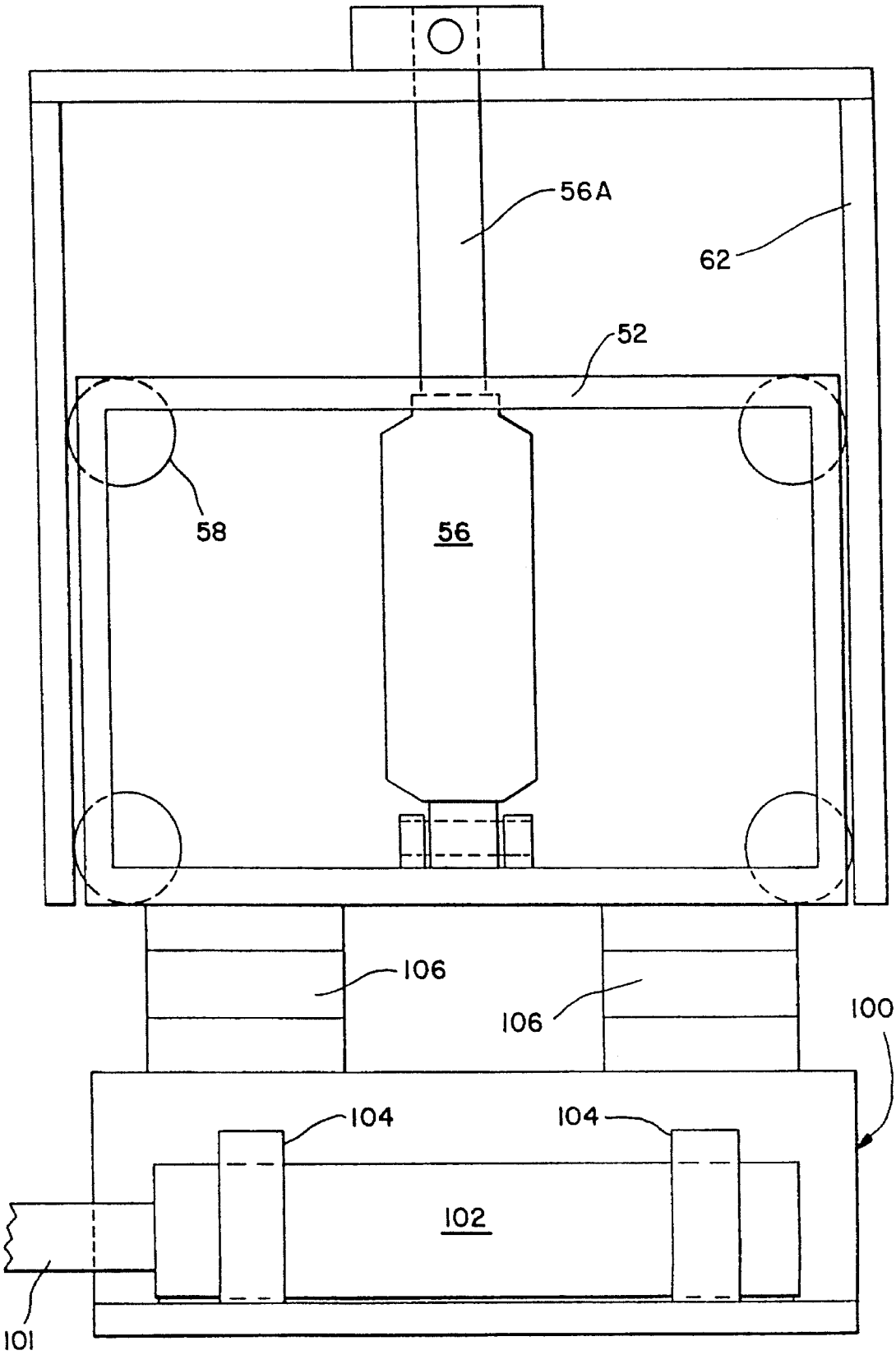
FIG. 9 is a side elevational view of another embodiment of edge compacting apparatus of the invention.

FIG. 9 is a side elevational view of another embodiment of the invention for applying the longitudinally mobile confinement edge force to the side edge of an asphalt lane being compacted by cylindrical drum 20. A shoe or plate 100 is included which presents a smooth vertical face for applying a confinement edge force to the asphalt lane.

Attached to plate 100 by clamps 104 is an eccentric weight vibrator powered by flexible shaft 101. The shaft is driven by any desired power source, e.g., hydraulic motor, electric motor, gas engine, etc.

The plate is attached to the lower end of housing 52 through rubber couplers 106 so that the plate 100 is able to vibrate relative to the housing 52. Hydraulic cylinder 56 is used to raise or lower plate 100 as desired relative to enclosure 62. The length and height of plate 100 may vary, as desired. The plate may be composed of any suitable durable material such as metal (e.g., steel, stainless steel, brass, etc.) or durable plastic or composite materials.

The plate 100 is effective in compacting the edge of an asphalt lane. The frequency of vibration of the plate may vary as desired. The angle of the plate relative to a vertical axis may be adjustable in a manner similar to that described above in connection with tilting of roller 50.

Figure 10:
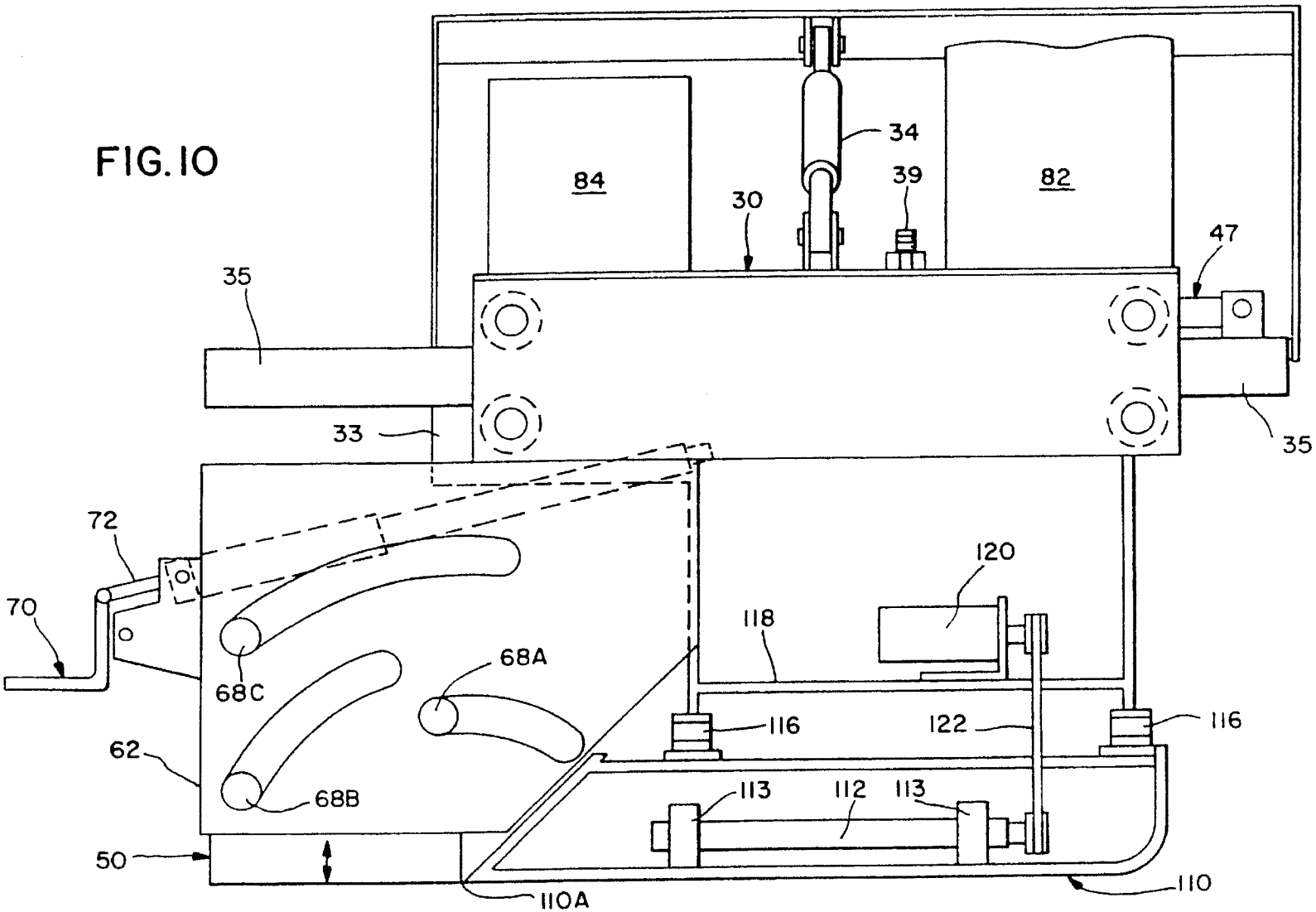
FIG. 10 is a front elevational view of another embodiment of apparatus of the present invention.
Figure 11:
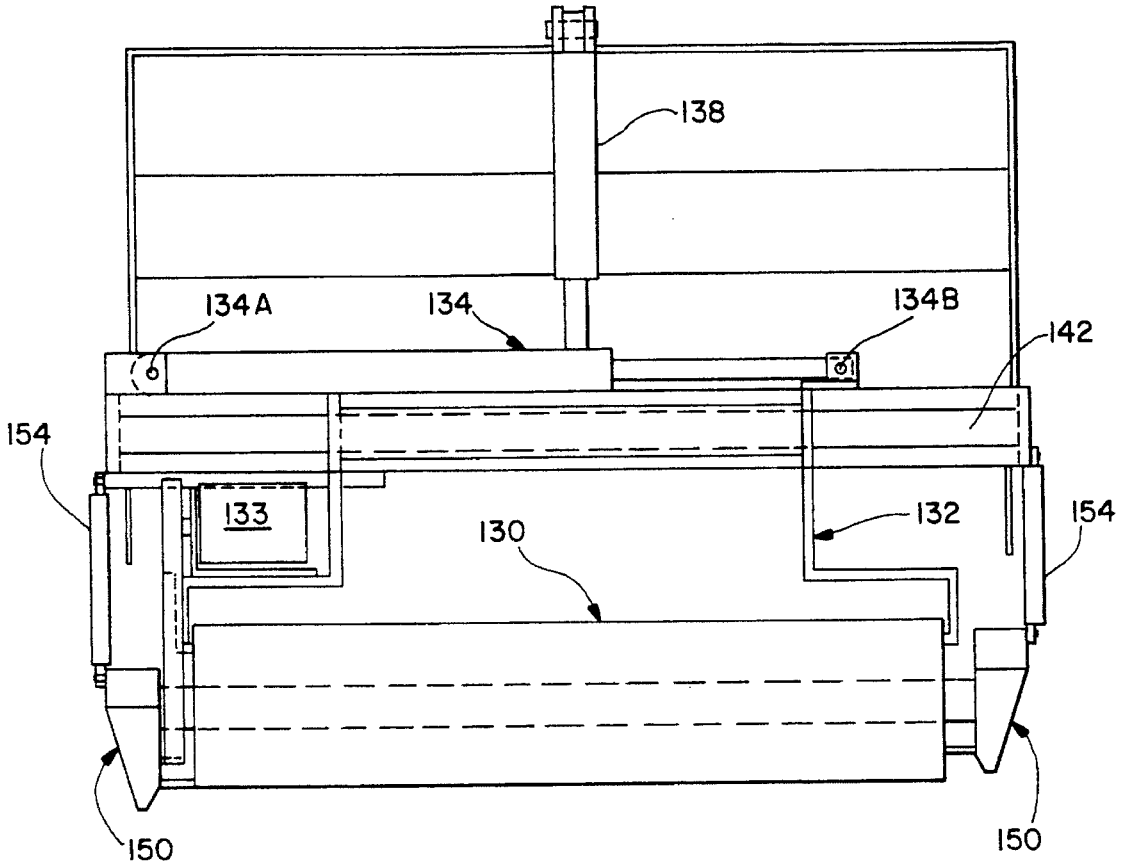
FIG. 11 is a front elevational view of another embodiment of apparatus of this invention.
Figure 12:
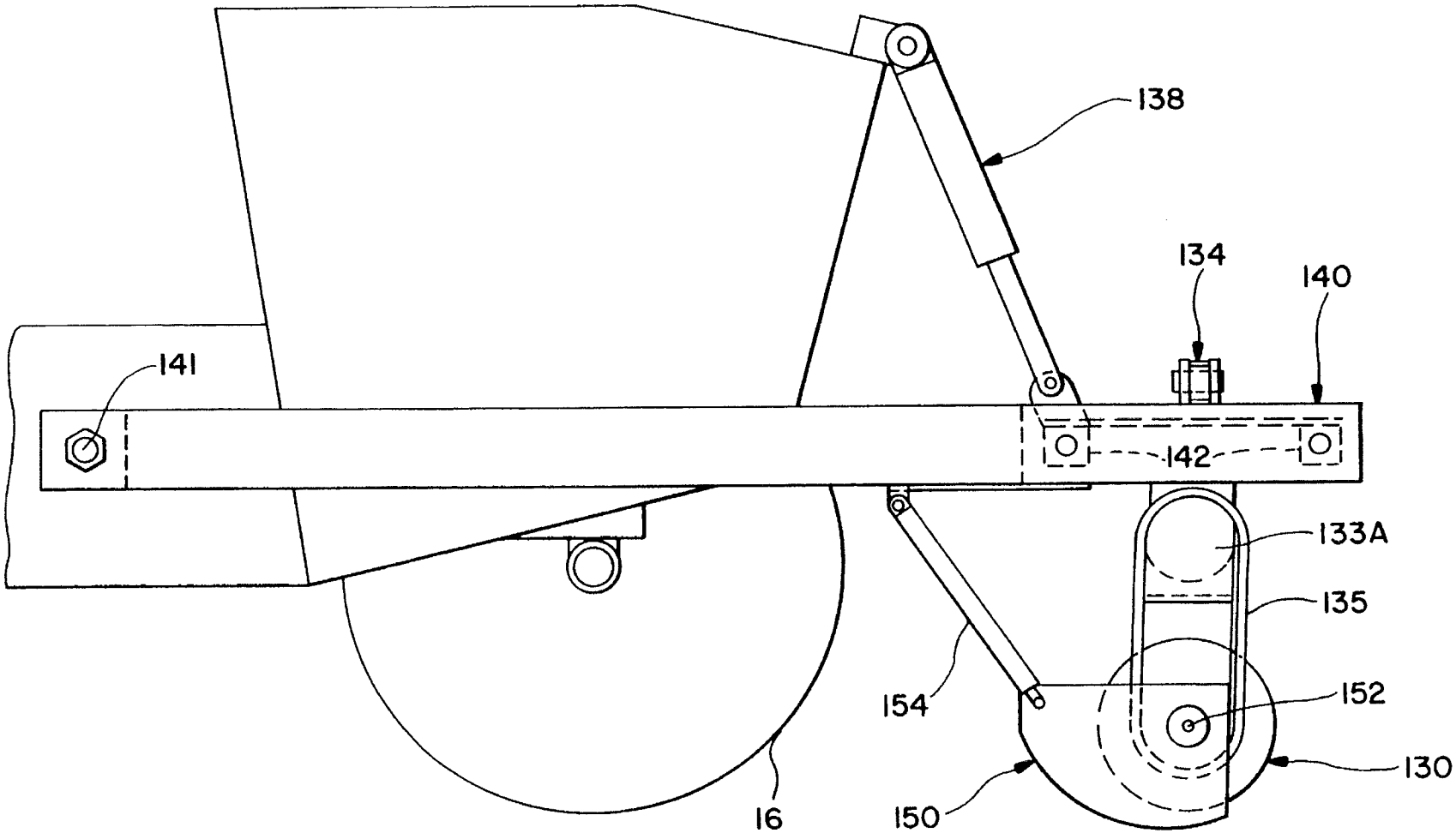
FIG. 12 is a side elevational view of the forward portion of the embodiment shown in FIG. 11.

FIG. 10 illustrates a front elevational view of another embodiment of apparatus of the invention. In this apparatus the cylindrical drum 20 has been replaced with a horizontal vibrating plate 110. Attached to this plate by clamps 113 is a vibrator 112. Motor 120 powers the eccentric weight vibrator 112 by means of endless belt 122. The plate is attached to framework 118 through rubber couplers 116. The vibrating plate is effective in compacting asphalt concrete beneath the plate and is an alternative to use of the rotating cylindrical drum 20 as described above. The size of the plate may vary, of course. A plurality of horizontal plates could also be used.

For side edge compaction of the asphalt concrete, any of the components shown above may be used in combination with the vibrating plate. In FIG. 10, the vertical roller 50 (shown in raised position) is positioned adjacent side edge 110A of the plate. The roller can be moved downwardly below the plane of plate 110 any desired amount for side edge compacting.

Another alternative for side edge compacting is to use either a stationary shoe or plate, or a vibrating shoe, or the endless belt, all as described above.

As is known in the art, it is important to wet the cylindrical drum, vertical roller, compacting shoe, etc. with water or other suitable material (e.g., soap solution) to prevent the asphalt concrete from sticking to these components during use. There are numerous systems and techniques available for doing that to prevent sticking. If desired, scrapers may also be used to remove asphalt which has become adhered to the various working surfaces.

The apparatus described herein provides very uniform density to compacted asphalt concrete across the full width of the mat. In order to measure or determine the actual density achieved, it is very advantageous to use a Troxler continuous density gauge, or equivalent apparatus. Such device enables the workman to determine the actual density of the compacted mat in a continuous manner. The device can be attached to and carried by the compacting apparatus described herein so that a continuous reading of the asphalt mat density is obtained. In this manner the workman can operate the compacting apparatus as required in order to attain the predetermined desired density across the full width of the mat.

Thus, the apparatus provided by the present invention may be conveniently attached to the forward end of existing compacting machines, or it may be a self-contained unit for compacting asphalt concrete. The apparatus assures that uniform compaction of asphalt concrete is obtained across the full width of the mat. This uniformity of compaction density greatly enhances the useful life of an asphalt concrete mat.

In FIGS. 11–14 there is illustrated another embodiment of apparatus useful in this invention for uniform compaction of asphalt concrete. This embodiment includes a cylindrical roller 130 rotatably supported forwardly of, and parallel to, the large cylindrical drum 16 of an existing compacting vehicle. The roller 130 is supported by a frame or carriage 132 which is laterally movable on horizontal rails 142 on frame 140. Hydraulic cylinder 134 is secured at one end 134A to frame 140 and is attached at its opposite end 134B to carriage 132. Cylinder 134 controls lateral movement of roller 130 relative to the vehicle.

If desired, roller 130 may be rotatably powered by means of a hydraulic motor 133 which powers gear 133*a* and chain drive 135. It is optional, however, to include motor 133. Rather, roller 130 could be simply freely rotating on axle 130A.

Adjacent each end of roller 130 there is a shoe 150 which is pivotably attached to the end of the roller with a pin or bolt 152 on axle 130A. A hydraulic cylinder 154 is connected between each shoe and the frame 140. Cylinder 154 controls the rotational position of the shoe relative to the roller 130. Because each of the shoes 150 is arc-shaped, and because the point of attachment of the shoe to the roller is near an upper corner of the shoe, the extent to which the lower portion of the shoe extends below the roller 130 may be varied by means of hydraulic cylinder 154. For example, when the asphalt concrete mat being compacted is very thin (e.g., one inch; 2.5 cm), the shoe 150 should be in the position shown in FIG. 12 such that the lower portion of the shoe extends below the roller 130 about one inch. When the asphalt concrete layer being compacted is very thick (e.g., about 4 inches; 10 cm), the cylinder 154 may be extended so that shoe 150 is pivoted forwardly, whereby the shoe extends below roller 130 about 4 inches. Thus, the position of shoe 150 may vary, for example, from a position where it is flush with the bottom of roller 130 to a position where it extends downwardly greater than 4 inches below roller 130, as desired.

Only one of the shoes 150 is in a downward position at a time. Thus, regardless of the direction of movement of the compacting vehicle, it is not critical which side of the vehicle is adjacent the edge of the asphalt concrete mat being compacted. The roller 130 is laterally adjustable relative to the vehicle, and a shoe 150 is carried by each of the rollers. Thus, the desired edge confinement force can be applied to the mat in any situation.

Adjustable down pressure is applied to frame 140 and roller 130 by means of hydraulic cylinder 138 which is connected between frame 140 and the vehicle. The rear end of frame 140 is pivotably secured to the vehicle by bolt or pin 141.

Figure 13:
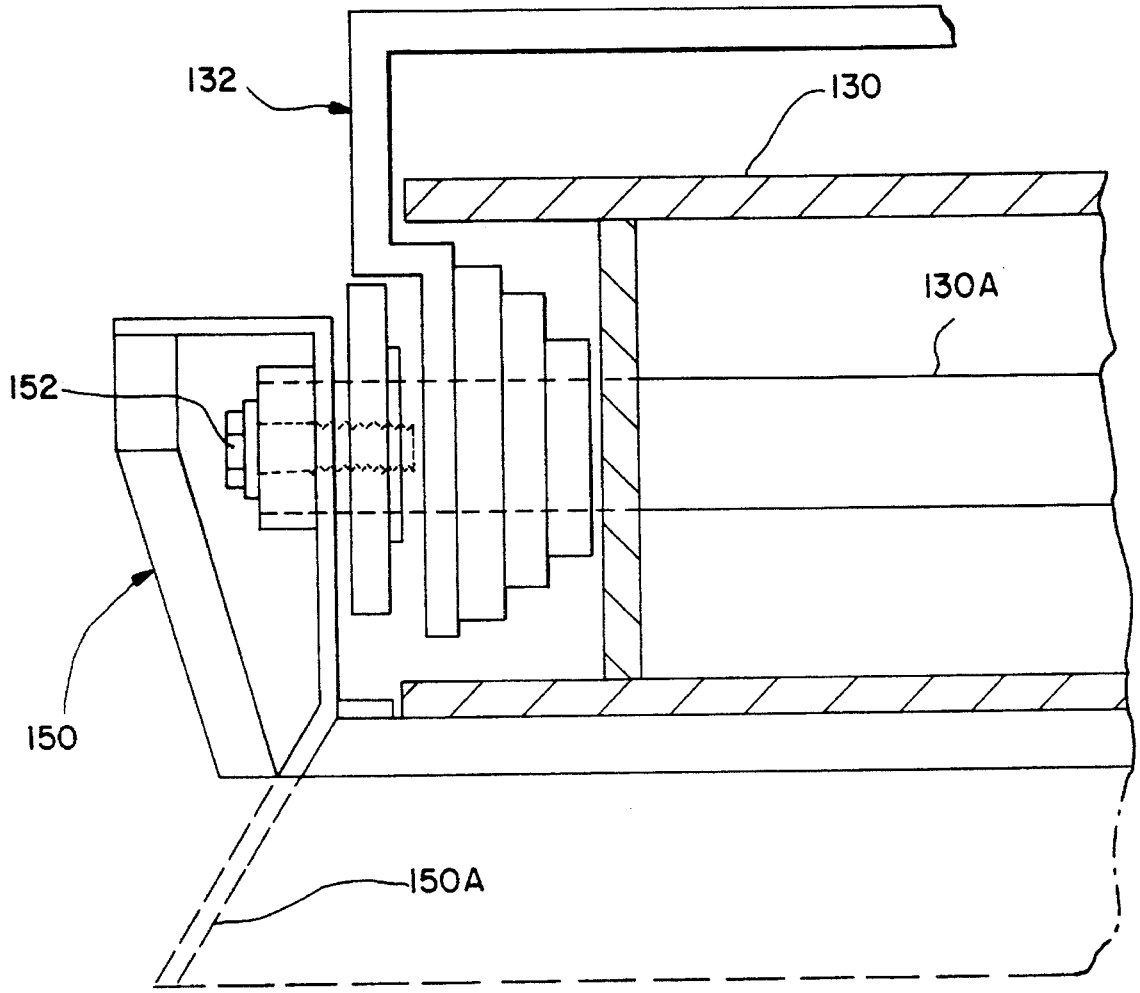
FIG. 13 is a front elevational view of a portion of the apparatus shown in FIG. 11.
Figure 14:
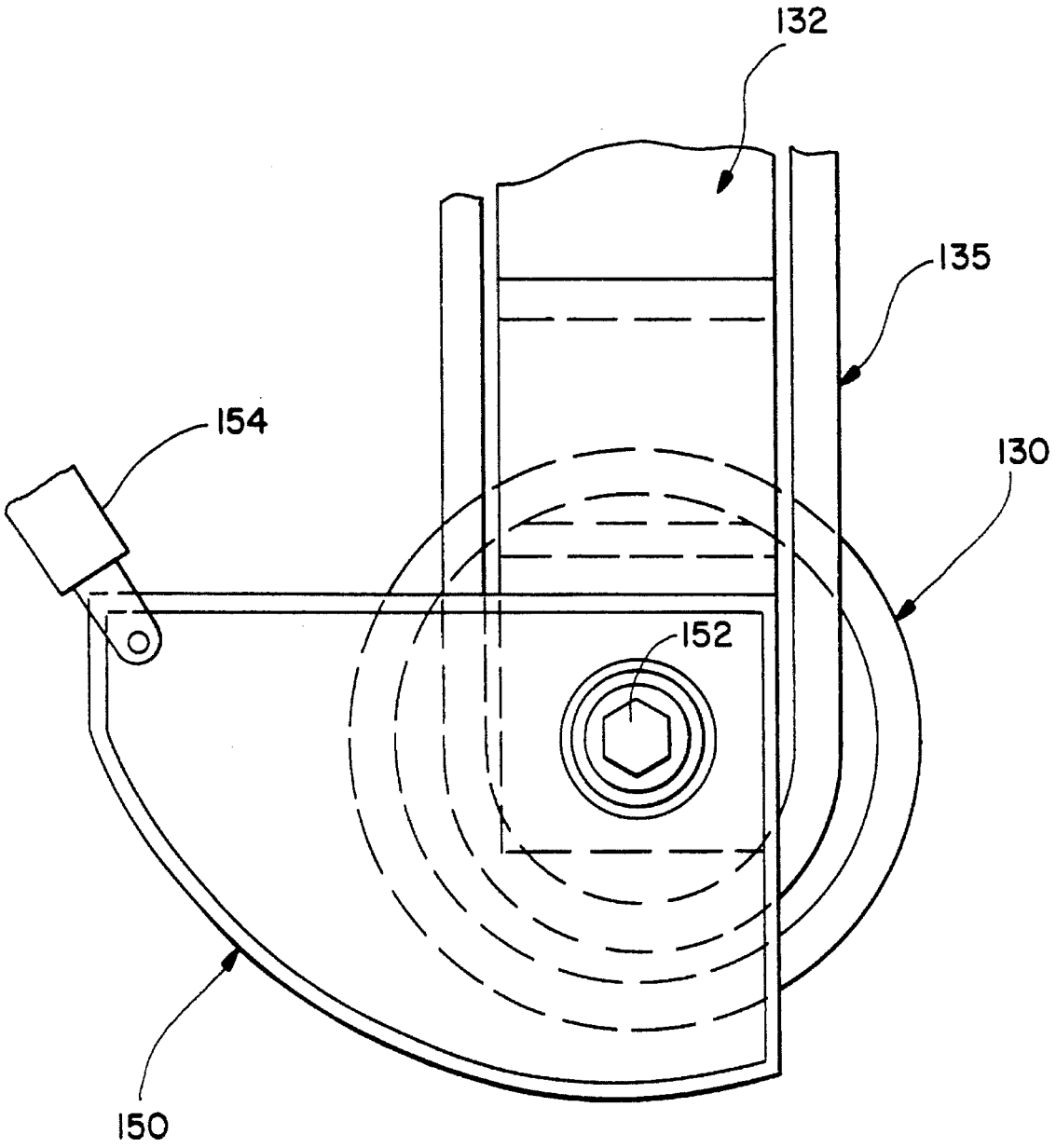
FIG. 14 is a side elevational view of a portion of the apparatus shown in FIG. 11.

The shoe 150 may include any desired surface 150A for applying the confinement edge force to the asphalt concrete mat being compacted. In FIG. 13 the broken lines indicate the inside surface 150A of shoe 150 in an extended downward position and angled outwardly at an angle of about 30°. This angle may instead be 0°, 5°, etc., as desired.

The size of the roller 130 may vary from about 8 inches in diameter up to about 24 inches in diameter or even larger depending upon the size and design of the compacting vehicle to which the apparatus of this invention is attached. As explained above, roller 130 may be rotatably driven or it may be freely rotatable, as desired.

Other variations are possible without departing from the scope of this invention.

What is claimed is:

1. In apparatus of the type including a vehicle having a forward end, a power source for propelling the vehicle and ground engaging means, wherein the improvement comprises:

(a) a cylindrical drum having first and second ends; said drum rotating about a horizontal axis; wherein said drum is attached to and supported by said forward end of said vehicle; wherein downward force exerted by said drum is adjustable;

(b) confinement edge force means adjacent to said first end of said cylindrical drum and extending below said drum; wherein said confinement edge force means is laterally adjustable along a horizontal axis.

2. Apparatus in accordance with claim 1, wherein said cylindrical drum is carried by a frame member which is hingedly attached to said forward end of said vehicle; wherein down pressure on said drum can be adjusted by means of a hydraulic cylinder connected between said frame member and said vehicle.

3. Apparatus in accordance with claim 1, wherein an angle is defined between said confinement edge force means and said cylindrical drum; and wherein said angle is adjustable.

4. In apparatus of the type including a vehicle having a power source for propelling the vehicle, ground engaging means, and compacting means for compacting asphalt concrete; wherein the improvement comprises:

(a) a cylindrical drum having first and second ends; said drum rotating about a horizontal axis; wherein said drum is attached to and supported by said vehicle; wherein downward force exerted by said drum is adjustable;

(b) confinement edge force means adjacent to said first end of said cylindrical drum and extending below said drum; wherein said confinement edge force means is laterally adjustable along a horizontal axis.

5. Apparatus in accordance with claim 4, wherein said cylindrical drum is carried by a frame member which is hingedly attached to said vehicle; and further comprising a hydraulic cylinder connected between said frame member and said vehicle; wherein down pressure on said cylindrical drum can be adjusted by means of said hydraulic cylinder.

6. Apparatus in accordance with claim 5, wherein said cylindrical drum is laterally movable relative to said vehicle.

7. Apparatus in accordance with claim 6, further comprising a hydraulic cylinder which is adapted to move said cylindrical drum laterally relative to said vehicle.

8. Apparatus in accordance with claim 4, wherein an angle is defined between said confinement edge force means and said cylindrical drum; and wherein said angle is adjustable.

9. Apparatus in accordance with claim 4, wherein said confinement edge force means comprises a first shoe member pivotably attached to said first end of said drum; wherein said shoe member includes a downwardly-extending edge portion.

10. Apparatus in accordance with claim 9, wherein said shoe member is arc-shaped, and wherein the extent to which said edge portion extends below said drum is determined by the extent of rotation of said shoe member relative to said drum.

11. Apparatus in accordance with claim 10, further comprising a hydraulic cylinder attached between said shoe member and said frame for controlling the rotational position of said shoe member relative to said drum.

12. Apparatus in accordance with claim 9, further comprising a second shoe member pivotably attached to said second end of said drum; wherein said second shoe member includes a downwardly-extending, vertically-adjustable edge portion.

13. Apparatus in accordance with claim 4, wherein said confinement edge force means comprises a roller which rotates about a generally-vertical axis.

14. Apparatus in accordance with claim 13, wherein said roller is vertically adjustable.

* * * * *